United States Patent [19]

Nerenberg

[11] 4,197,963

[45] Apr. 15, 1980

[54] END CLOSURE FOR LINED CARTONS

[75] Inventor: Robert W. Nerenberg, Middletown, Ohio

[73] Assignee: The Interstate Folding Box Company, Middletown, Ohio

[21] Appl. No.: 145

[22] Filed: Jan. 2, 1979

[51] Int. Cl.[2] ..... B65D 5/56

[52] U.S. Cl. ..... 220/462; 229/37 R

[58] Field of Search ..... 220/462, 463, 416, 418; 229/37 R

[56] References Cited

U.S. PATENT DOCUMENTS

| | | | |
|---|---|---|---|
| 3,051,367 | 8/1962 | Einhorn | 220/462 |
| 3,550,833 | 12/1970 | Rahenkamp | 229/37 R |

FOREIGN PATENT DOCUMENTS

| | | | |
|---|---|---|---|
| 706248 | 3/1965 | Canada | 220/462 |
| 769941 | 3/1957 | United Kingdom | 220/463 |
| 997547 | 7/1965 | United Kingdom | 220/463 |

*Primary Examiner*—Allan N. Shoap

*Attorney, Agent, or Firm*—Frost & Jacobs

[57] ABSTRACT

An improved end closure for a prelined carton formed from a knocked-down tubular carton structure, the end closure comprising an opposing pair of innermost closure flaps and an opposing pair of outermost closure flaps, the innermost flaps each being diagonally scored to define a triangular tab portion at one end thereof, the triangular tab portions being adhesively secured to the mouth of the liner mouth as an incident of erecting the carton, the tabs being folded inwardly by the liner mouth as it is expanded and flattened for sealing, the infolded tabs assisting in positioning the liner mouth for sealing and also serving to facilitate the infolding of the ends of the sealed liner mouth as an incident of infolding the innermost closure flaps to overlie the end of the carton body.

2 Claims, 7 Drawing Figures

END CLOSURE FOR LINED CARTONS

BRIEF SUMMARY OF THE INVENTION

This invention relates to paperboard cartons and more particularly to flat-folded paperboard cartons having tubular liners formed from limp films, such as high density polyethylene.

It has been the practice for many years to fabricate knocked-down lined cartons by advancing the carton blanks, which usually comprise a series of four body walls and a glue flap in side-by-side articulation with end closure flaps hingedly connected to the end edges of the body walls, in a path of travel and applying stripes or spots of adhesive to the inner surfaces of the body walls and glue flap, whereupon a flat-folded tubular liner is deposited on the innermost pair of adjoining body walls, followed by the infolding of the outermost body walls and glue flaps to form a knocked-down, flat-folded carton structure which may be stored and shipped in the flat-folded condition. In the hands of the packager, the lined carton blanks are first erected or "squared-up", followed by the formation of a flat fin type seal across one end of the projecting liner mouth and the closing and sealing of the adjoining end closure flaps. Thereafter the carton is inverted, filled with contents, the opposite projecting end of the liner closed and sealed, followed by the closing and sealing of the remaining end closure flaps. Various types of packaging apparatus are available for such purpose, exemplary apparatus being shown in U.S. Pat. No. 3,491,506, issued Jan. 27, 1970 and entitled "Alternate Station Container Feeding And Sealing System".

Recently there has been a trend toward the use of extremely thin liners formed from relatively limp flexible films which are less expensive than the liner materials previously used. These thin liners have presented a problem, particularly where the cartons are essentially square in cross-section, in that even though the liner is adhered to the inner surfaces fo the carton body walls, when the flat-folded cartons are erected, the projecting ends of the limp liner material do not always follow the carton body walls but rather buckle and collapses inwardly in an irregular manner with the result that the liner cannot be engaged by the fingers on the packaging apparatus which expand and flatten the ends of the liner so that they may be sealed.

The present invention provides an end closure construction for cartons lined with a limp lining material, the end closure initially serving to insure erection of the liner mouth to fully "squared-up" condition as the carton body is erected, the end closure additionally serving to implement the flattening of the liner mouth by the liner engaging fingers as well as the infolding of the end of the liner after it has been sealed as an incident of the infolding and sealing of the end closure flaps.

In accordance with the invention, the end closure comprises an innermost pair of opposing closure flaps each having a width approximately equal to one-half the cross-sectional width of the carton body and an outermost pair of closure flaps at least one of which is a full width flap. Each of the innermost flaps is provided with a diagonal score line extending from an innermost corner edge of the flap to approximately the center of its outermost side edge, thereby defining a triangular shaped tab which is foldable relative to the remainder of the flap. The triangular portions of the innermost closure flaps are adhesively secured to the underlying areas of the liner which they contact when the carton and liner are in the flat-folded condition. With this arrangement, when the carton body walls are erected, the end closure flaps will follow the body walls to which they are secured, and in so doing the innermost closure flaps will carry the liner mouth with them, thereby insuring that the liner mouth is fully erected and hence in a position to be flattened and sealed.

The expansion and flattening of the liner mouth is usually accomplished by a pair of fingers which are inserted into the liner mouth and expanded outwardly in opposite directions, thereby expanding the liner mouth in opposite directions and at the same time flattening and juxtaposing its opposite side edges for sealing. In accordance with the invention, the liner mouth is expanded in the direction of the opposing innermost closure flaps, such movement being implemented by the triangular portions of the closure flaps which are secured to the liner and are folded inwardly by the liner as it is expanded and flattened. It has been found that the attachment of the liner to the triangular portions of the innermost closure flaps enhances the action of the fingers as they flatten the liner for sealing. Once infolded, the triangular tabs also serve as folding edges for the liner when the end closure flaps are thereafter infolded to close the carton. Consequently, the attachment of the liner mouth to the triangular portions of the innermost closure flaps serves not only to insure initial erection of the liner mouth but also to provide enhanced stability to the flattened mouth during sealing and a neatly folded liner when the end closure flaps are closed and sealed.

DETAILED DESCRIPTION

Figure 1:
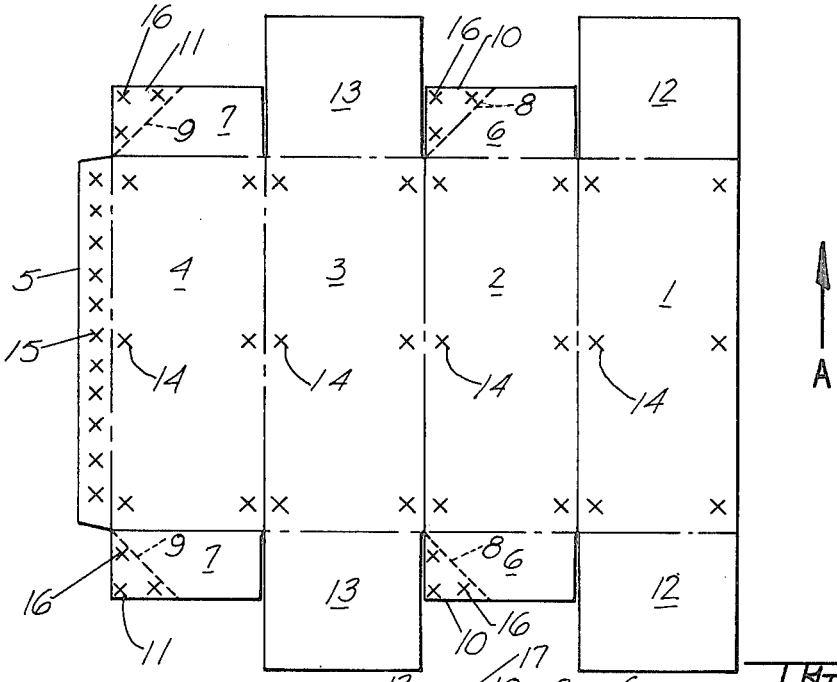
FIG. 1 is a plan view of a carton blank incorporating end closures in accordance with the present invention.

FIG. 1 illustrates a paperboard carton blank which has been cut and scored to define enclosing body walls 1, 2, 3 and 4 in side-by-side articulation, the body wall 4 having a longitudinal glue flap 5 extending along its outermost side edge. End closure flaps are provided at the opposite ends of the carton body walls. In the embodiment illustrated, the top and bottom closures are identical, each comprising innermost end closure flaps 6 and 7 hingedly connected to the end edges of body walls 2 and 4, respectively. In accordance with the invention, the closure flaps 6 and 7 are provided with diagonal lines of fold 8 and 9, respectively, which define triangular tab portions 10 and 11, the score lines 8 and 9 extending diagonally through the innermost closure flaps from an innermost corner edge to approximately the midpoint of the outermost side edge. Preferably the width of the innermost closure flaps 6 and 7 will be slightly less than one-half the width of the erected carton body so that they will not overlap when infolded. The body walls 1 and 3 are provided at their opposite ends with outermost closure flaps 12 and 13, respectively, at least one of which is a full width closure flap.

In the fabrication of a blank of the character described using conventional folding and gluing equipment, the blank will be advanced in the direction indicated by the Arrow A in FIG. 1, whereupon spots or stripes of adhesive, indicated at 14, will be applied to the inner surfaces of the carton body walls. An adhesive stripe 15 is also applied to glue flap 5 and, in accordance with the invention, the triangular tab portions 10 and 11 are coated with adhesive, indicated at 16. While in the embodiment illustrated the carton body walls are of substantially equal width, resulting in a carton which is substantially square in cross-section when erected, it will be understood that the relative dimensions of the body walls do not constitute a limitation on the invention and they may vary in size as desired.

Figure 2:
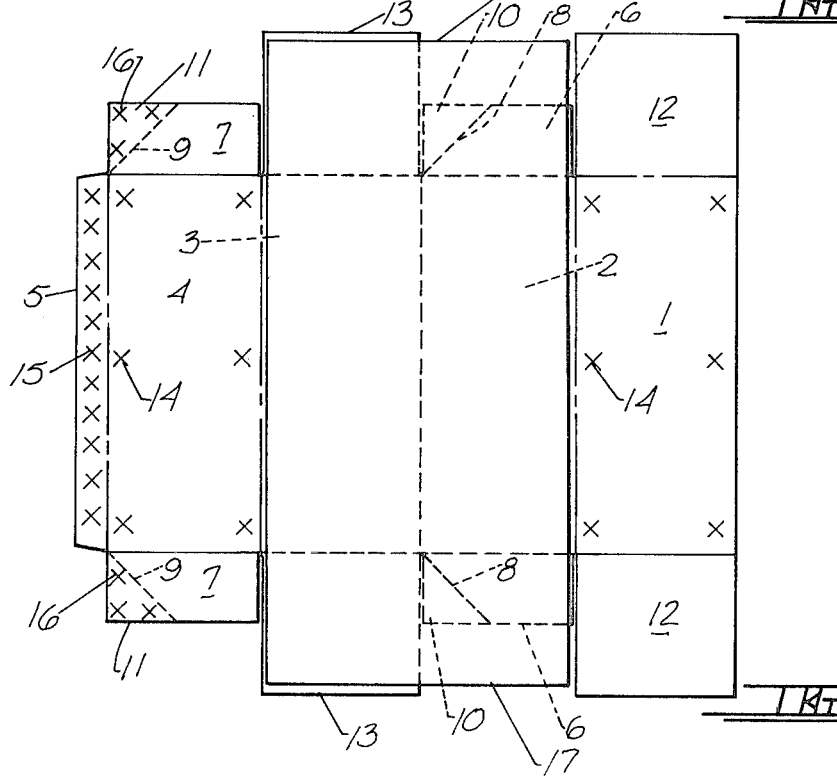
FIG. 2 is a plan view similar to FIG. 1 showing a tubular liner juxtaposed to the carton blank.

As the carton blank advances in its path of travel, a flat-folded tubular liner 17 is deposited on the inner surface of intermediate body wall panels 2 and 3, the liner, as seen in FIG. 2, being of a length to overlie the sets of end closure flaps 6 and 13. The undersurface of the liner 17 will be adhered to the body walls 2 and 3, and to the triangular tab portions 10 of innermost end closure flap 6 by reason of the adhesive spots 14 on the body walls and the adhesive coating 16 on the triangular tab portions. Thereafter, the outermost body walls 1 and 4 will be infolded and juxtaposed to the uppermost surface of liner 17, with the outermost marginal side edge of body wall 1 adhesively secured to glue flap 5, the carton thus assuming the knocked-down flat-folded condition illustrated in FIG. 3. The infolding of the body walls 1 and 4 and their respective end closure flaps results in the body walls 1 and 4 being secured to the uppermost side of liner 17, and similarly triangular tab portions 11 will be adhesively secured to the underlying end portions of the liner. The carton structures may be packaged, stored and shipped in the knocked-down, flat-folded condition.

Figure 3:
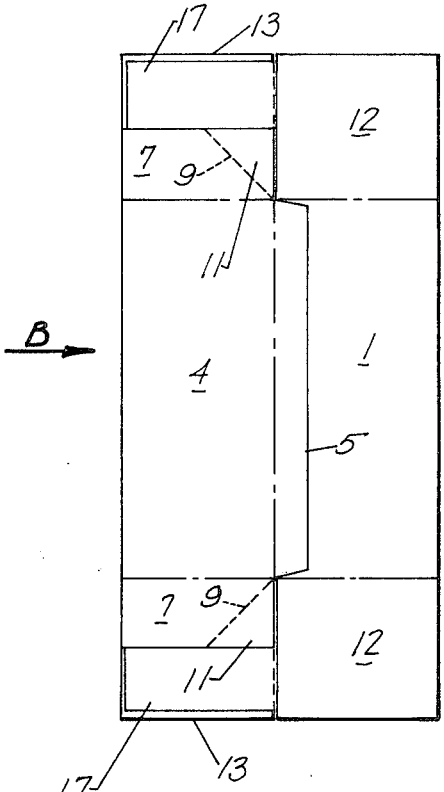
FIG. 3 is a plan view showing the carton blank and liner in the knocked-down, flat-folded condition.
Figure 4:
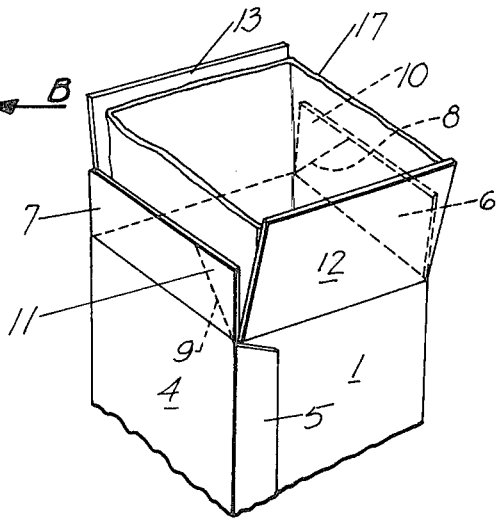
FIG. 4 is a fragmentary perspective view illustrating the carton and liner in the erected condition.

When the packager desires to erect or "square-up" the cartons, this may be done either manually or automatically by applying inwardly directed pressure to the opposite side edges of the flat-folded carton blank, as indicated by the Arrows B in FIG. 3, the carton blank being expanded to the erected condition illustrated in FIG. 4. Since the end closure flaps will follow the body walls to which they are secured as the carton body is erected, the opposite ends of the liner will be positively opened by reason of their attachment to the triangular tab portions 10 and 11 which are secured to opposite sides of the liner. If it were not for the adhesive attachment of the liner to the tab portions 10 and 11, the limp flexible liner would have a tendency to buckle or collapse inwardly rather than move to the erected condition.

Figure 5:
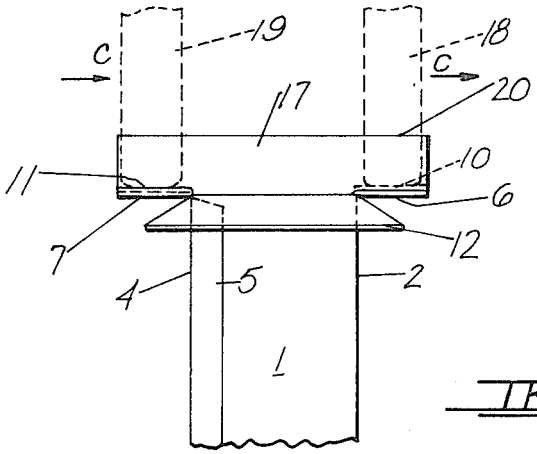
FIG. 5 is a fragmentary side elevational view illustrating the mouth of the liner in expanded and flattened condition.
Figure 6:
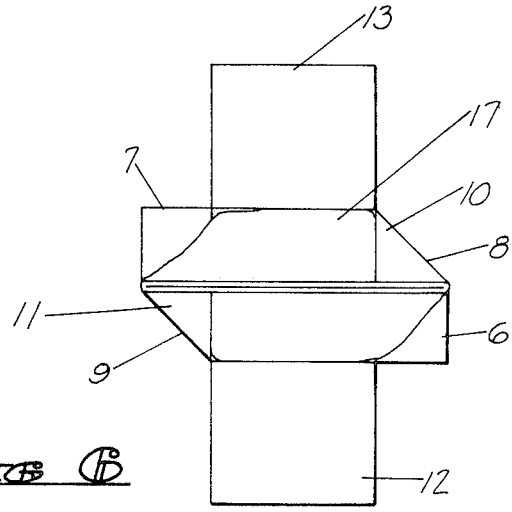
FIG. 6 is a top plan view of the liner in the condition illustrated in FIG. 5.
Figure 7:
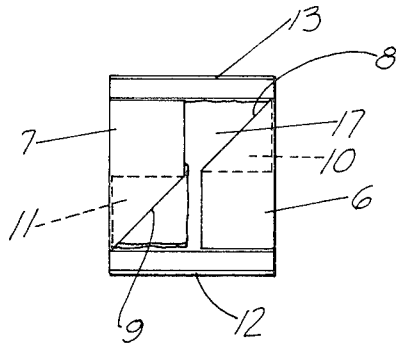
FIG. 7 is a top plan view illustrating the liner and innermost end closure flaps in the infolded condition.

Once the carton and liner have been erected, a pair of folding fingers, seen at 18 and 19 in FIG. 5, are inserted into the open end or mouth of the liner, whereupon the folding fingers are moved outwardly in the direction of the Arrows C seen in FIG. 5, which is in the direction of the innermost end closure flaps 6 and 7, thereby expanding and flattening the mouth of the liner as well as deflecting the innermost closure flaps 6 and 7 outwardly to an essentially horizontal position. Such movement results in the infolding of the triangular tab portions 10 and 11 which are adhesively secured to the liner. The adhesive attachment of the triangular tab portions to the liner implements the control of the liner when in its expanded and flattened condition with the result that the opposite sides of the liner mouth are more accurately positioned for heat sealing. It will be understood that once the liner mouth has been expanded and flattened, it will be engaged by opposing sealing rollers or bars which will form a seal closing the end of the liner. Such seal is indicated at 20 in FIG. 5.

Once the seal has been formed, the mouth of the liner is folded over so as to lie along the end edge of the carton body walls, whereupon the innermost end closure flaps 6 and 7 are infolded, carrying the ends of the liner with them, followed by the infolding of the outermost closure flaps 12 and 13 with the interposition of adhesive between the flaps to complete the end closure. The infolded triangular tab portions 10 and 11 facilitate the infolding of the liner in that they provide folding edges which assist in neatly folding the ends of the liner as the innermost end closure flaps are infolded. The improved end closure thus provides assurance that the liner mouth will be fully opened when the carton is erected and additionally assists in maintaining the liner mouth in proper position for sealing when it has been expanded and flattened, and the end closure also implements the infolding of the sealed liner mouth as an incident to the infolding of the end closure flaps.

What is claimed is:

1. In a prelined carton formed from a knocked-down tubular carton structure having opposing pairs of enclosing body walls with upper and lower ends, bottom closure flaps hingedly connected to the lower ends of said body walls, and a liner in said carton structure adhesively secured to the carton body walls, the liner having a mouth extending outwardly beyond the upper ends of the carton body walls, an improved top closure comprising a pair of innermost end closure flaps hingedly connected to the upper ends of a first pair of said opposing body walls and a pair of outermost closure flaps hingedly connected to the upper ends of the remaining pair of opposing carton body walls, said innermost end closure flaps each having an outermost side edge and an opposing pair of end edges, the combined widths of said innermost closure flaps being no greater than the cross-sectional distance between said first pair of opposing body walls when the carton is fully erected, a triangular tab having a base edge and a pair of side edges formed in each of said innermost closure flaps at one end thereof by a diagonal score line defining the base edge of said tab, one side edge of the tab being defined by an end edge of the closure flap and the other side edge by a portion of the outer side edge of the said flap, said tabs lying adjacent different ones of said outermost closure flaps and being adhesively secured to the abutting portions of the liner mouth, the tabs acting to draw the mouth of the liner to fully erected condition as the carton body walls are erected, the triangular tabs being foldable inwardly to overlie the innermost closure flaps and sandwich portions of the liner mouth therebetween as an incident of expanding and flattening the liner mouth in the direction of said innermost closure flaps, the infolded triangular tabs serving to stabilize the flattened liner mouth for sealing and also serving as folding edges for portions of the liner mouth as the innermost closure flaps are infolded as an incident of closing and sealing the top closure.

2. The carton construction claimed in claim 1 wherein said liner is formed from a limp flexible material, such as high density polyethylene, having a thickness of not greater than about 3 mils.

* * * * *